US005904423A

United States Patent [19]

Forschner et al.

[11] Patent Number: 5,904,423

[45] Date of Patent: May 18, 1999

[54] STIRRING ELEMENT FOR STIRRING GASES INTO LIQUIDS

[75] Inventors: Peter Forschner, Hasel; Rainer Krebs, Schopfheim; Hans-Jürgen Weiss, Kander, all of Germany

[73] Assignee: EKATO Ruhr-und Mischhtechnik GmbH, Schopfheim, Germany

[21] Appl. No.: 08/988,449

[22] Filed: Dec. 10, 1997

[30] Foreign Application Priority Data

Dec. 13, 1996 [DE] Germany ..... 296 21 683 U

[51] Int. Cl.[6] ..... B01F 3/04; B01F 7/26

[52] U.S. Cl. ..... 366/317; 261/93; 416/175; 416/183; 416/203; 416/228; 416/237

[58] Field of Search ..... 366/102–104, 366/262–265, 315–317, 342–343; 261/93; 416/227 R, 228, 237, 175, 183, 188, 203

[56] References Cited

U.S. PATENT DOCUMENTS

| | | | |
|---|---|---|---|
| 2,043,940 | 6/1936 | Van Thiel | 261/93 |
| 2,308,751 | 1/1943 | Guthrie et al. | 261/93 |
| 2,384,952 | 9/1945 | Miller | 261/93 |
| 3,100,628 | 8/1963 | Norris, Jr. | 366/317 |
| 3,604,690 | 9/1971 | Traelnes | 366/317 |
| 5,198,156 | 3/1993 | Middleton et al. | 366/317 |
| 5,246,289 | 9/1993 | Middleton et al. | 261/93 |

FOREIGN PATENT DOCUMENTS

| | | | |
|---|---|---|---|
| 2300205 | 4/1973 | Germany | 261/93 |
| 1414438 | 8/1988 | U.S.S.R. | 366/317 |

*Primary Examiner*—Charles E. Cooley
*Attorney, Agent, or Firm*—Sixbey, Friedman, Leedom & Ferguson; David S. Safran

[57] ABSTRACT

A stirring element (10), especially a gasing stirring element for stirring liquids and introducing a gas, preferably air, to the liquids. The stirring element has a hub (12) for attachment to a stirring shaft and a support disk (14) joined to the hub (12), a plurality of stirring blades (16) being attached to a peripheral edge of the support disk (14). To achieve a low output power coefficient, each stirring blade (16) is made of a wedge-shape that is directed in the direction of rotary motion of the stirring element (10). Preferably, radially inner end sections (22, 24) of two sides (18, 20) of the stirring blade (16) are angled relative to sides (18, 20) outwardly with reference to the direction of rotary motion of the stirring element (10). The stirring element (10) simplifies gas feed and prevents clogs. By providing the support disk (14) with a conical shape having a ring of teeth (26) on its outer edge, a uniform distribution and good dispersion of the gas bubbles is obtainable.

16 Claims, 3 Drawing Sheets

FIG. 3
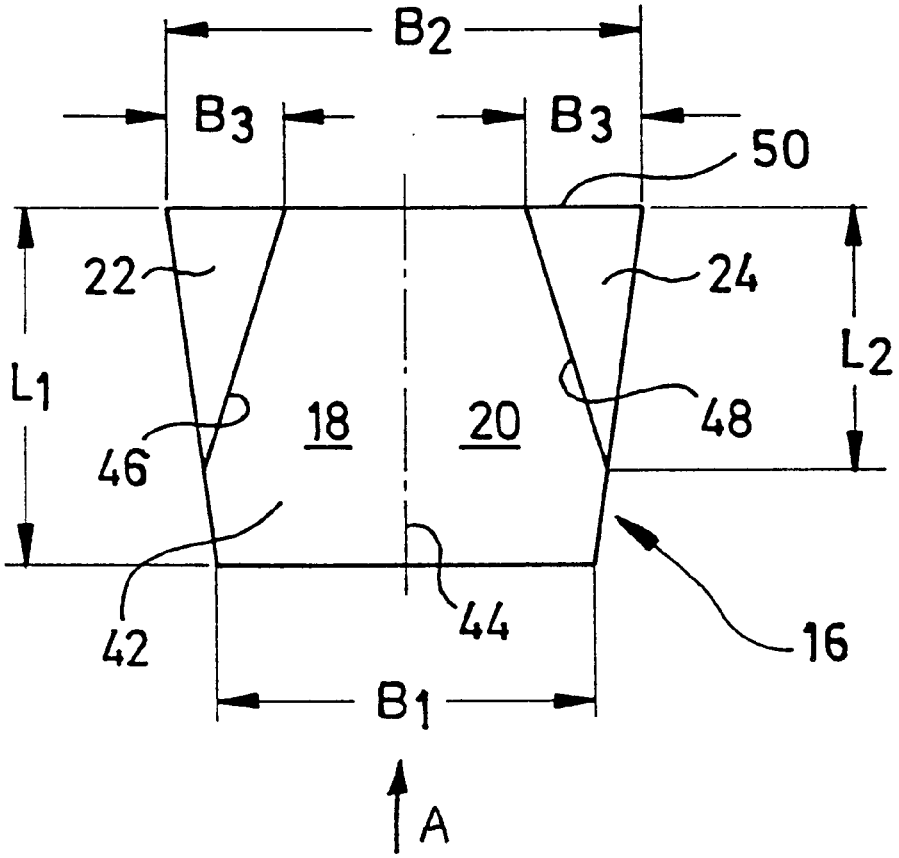
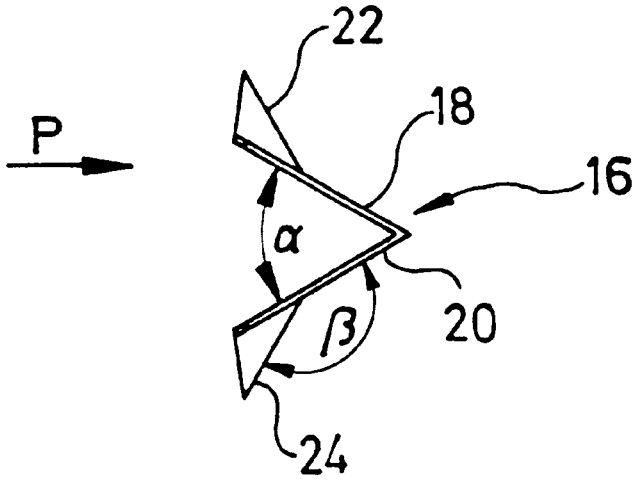
FIG. 4

STIRRING ELEMENT FOR STIRRING GASES INTO LIQUIDS

BACKGROUND OF THE INVENTION

1. Field of the Invention

The invention relates to a stirring element, especially a gasing stirring element for stirring of liquids to which a gas, for example, air, is supplied, with a hub for attachment to a stirring shaft, and a support disk joined to the hub; a plurality of stirring blades is attached to the peripheral edge of the support disk.

2. Description of Related Art

A gas supplied to a liquid to be stirred is dispersed into bubbles as small as possible by means of a gasing stirring element in order to form a large surface for mass transfer between the gas and liquid.

Usually this gasing stirring element comprises a disk stirrer with stirring blades and an annular gas distributor, along whose apex line round holes are formed which holes feed the gas to the rotating disk stirrer, by whose shearing action the gas is further dispersed. The rotational motion of the stirring element, however, produces a negative pressure on the back of the stirring blades which leads to formation of gas cushions there. These gas cushions impart a streamlined contour to the stirring blades which is expressed in a strong power drop at given rpm.

Since, for mass transfer, two parameters, specifically the amount of gas and the power input, are determined by the stirring process, in order to be able to control the adjustment of the desired mass transfer, the power reduction deficit must be balanced by increasing the rpm. This engenders considerable cost in control engineering and hardware.

SUMMARY OF THE INVENTION

A primary object of the present invention is to devise a stirring element which essentially eliminates the above-mentioned defects.

In accordance with the invention, this object is achieved by making the stirring blades angled in a wedge shape in the direction of motion (direction of rotation). This wedge angle is feasiblely about 45° to 75°, but is preferably about 60°.

Radial inner end sections of two sides of each wedge-shaped stirring blade are advantageously angled outward relative to the direction of rotary motion of the stirring element. The angle between the respective side and its angled end section is preferably about 120 to 160°, especially about 140°.

The end sections are feasiblely made triangular, their width increasing radially from the outside to the inside. The radial length of the end sections can, here, preferably be roughly two thirds to three fourths of the radial length of the stirring blade.

According to another embodiment of the invention, the support disk for the stirring blades is angled or bent from the stirring plane outwardly to the bottom, so that a cavity is formed under the support disk. In this embodiment, the gas can be routed into the cavity under the support disk by means of a simple tube, simplifying gas feed. Clogs when solids are present or when solids form are prevented.

Preferably the support disk is made arched, stepped, tapering or especially conical. In the case of a conical support disk, the opening angle of the cone is feasiblely about 140 to 150°, especially about 146°. On its outer peripheral edge, the support disk is preferably provided with triangular teeth which lie in the jacket surface of the cone or which can be angled relative to it to the top or bottom. Gas feed takes place preferably in the area of the tip of the cone of the conical support disk.

These and further objects, features and advantages of the present invention will become apparent from the following description when taken in connection with the accompanying drawings which, for purposes of illustration only, show a single embodiment in accordance with the present invention.

BRIEF DESCRIPTION OF THE DRAWINGS

FIG. 3 is a plan view of a stirring blade of the stirring element in a still flat, unbent state;

FIG. 4 schematically shows a view of the finished stirring blade in the direction of arrow A in FIG. 1.

DETAILED DESCRIPTION OF THE PREFERRED EMBODIMENT

Figure 1:
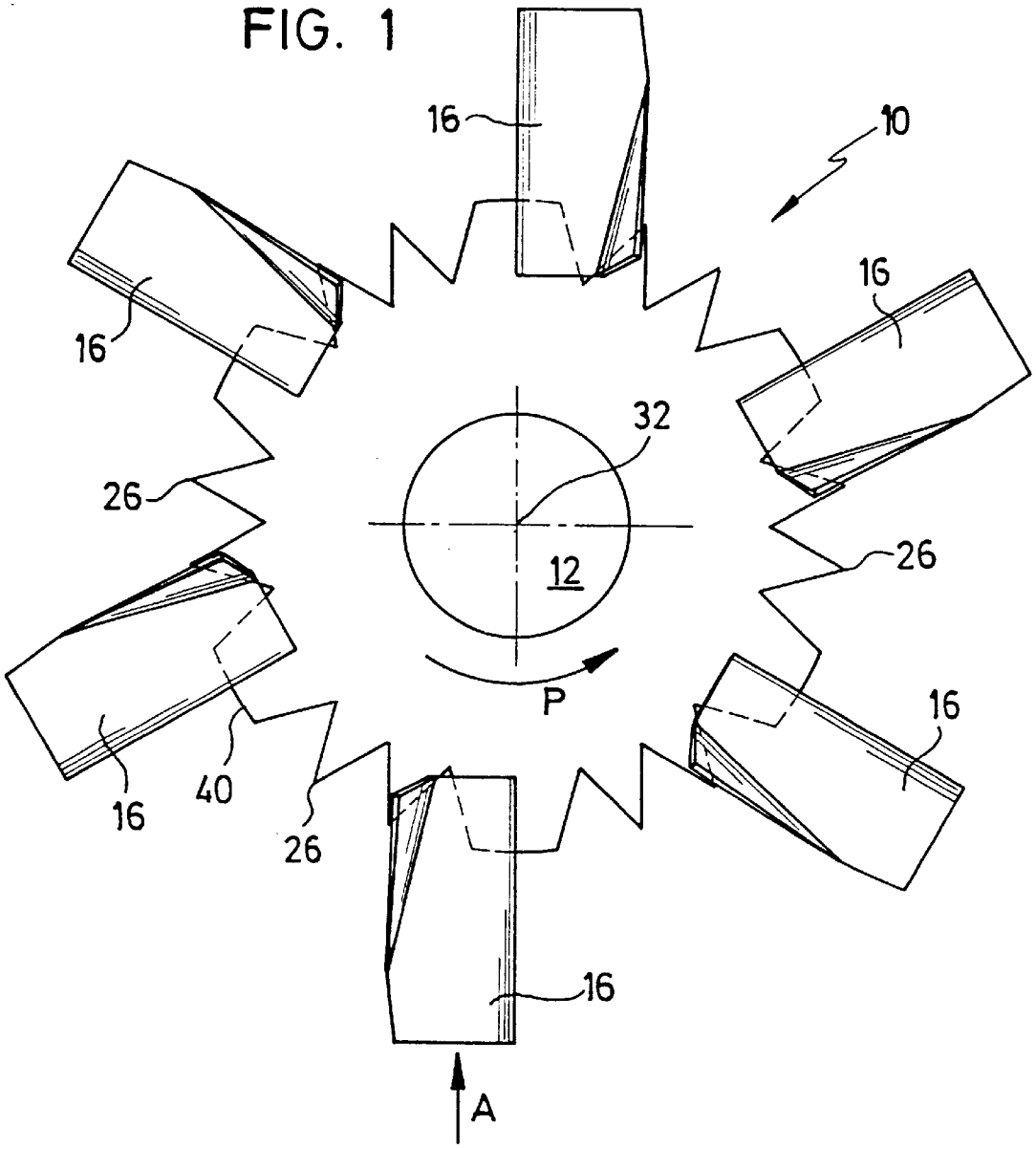
FIG. 1 is a schematic plan view of the stirring element of the present invention.

FIG. 1 shows an overhead view of a stirring element 10 having a hub 12 for attaching the stirring element 10 to a stirring shaft (not shown).

A support disk 14 is securely attached to hub 12; on the outer peripheral edge of the support disk 14, several stirring blades 16, which extend essentially radially outwardly, are securely mounted. Stirring element 10 has a center axle 32. In operation, the stirring element 10 turns in the direction of arrow P around this center axle 32 which forms the stirring axis. The plane of rotation or stirring plane 30 lies transversely to stirring axis 32.

Figure 2:
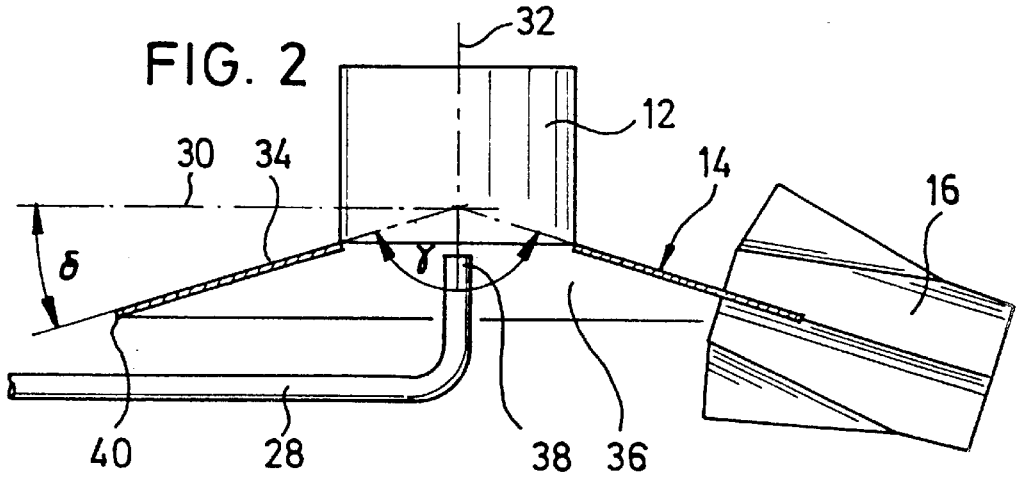
FIG. 2 is schematic longitudinal section through the middle axis of the stirring element shown in FIG. 1.

As FIG. 2 shows, support disk 14 has a frusto-conical shape, the imaginary tip of the cone lying preferably on stirring axis 32. Conic wall 34 of disk 14 extends downwardly away from hub 12 and forms an angle $\delta$, of for example 17°, with respect to the stirring plane 30. In this case, the cone opening angle $\gamma$ is 146°. Preferably, however, the cone opening angle $\delta$ can be in the range from roughly 140° to 150°. A cavity 36 is, thus, formed below the frusto-conical support disk 14 and under hub 12.

Figure 5:
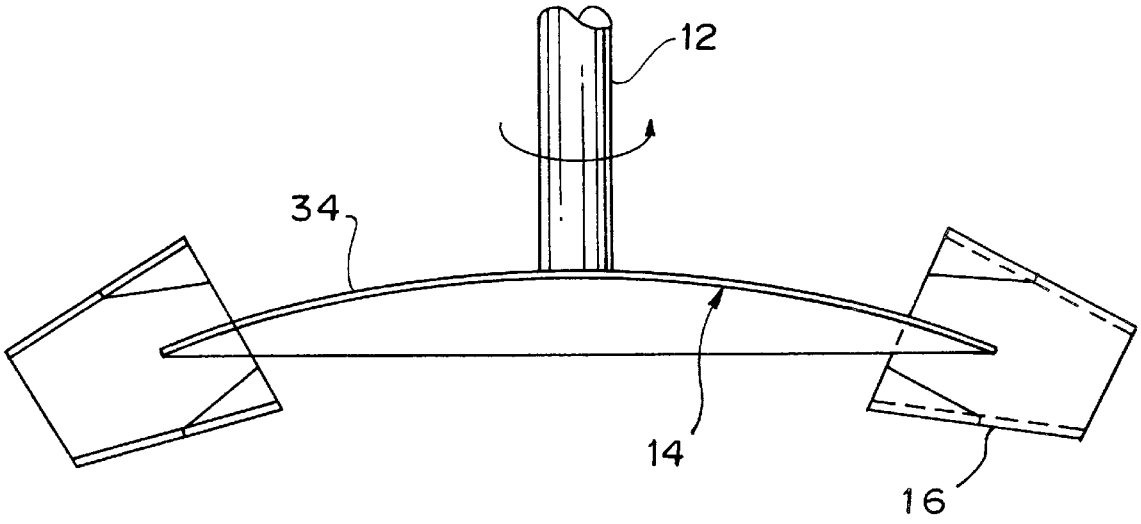
FIG. 5 is a view similar to that of FIG. 2, but showing an embodiment with a support disk with an arched wall.

The support disk 14 can also be made differently; for example, it may be stepped, conical or arched (FIG. 5), just as long as a cavity 36 is formed under it.

As FIG. 2 shows, a feed pipe 28 is provided for introducing a flow of gas into the cavity 36. The mouth 38 of pipe 28 is preferably located under the imaginary cone tip and concentrically relative to the stirring axis 32.

As FIG. 1 shows, support disk 14 is provided on its outside peripheral edge 40 with triangular teeth 26 which run along the entire periphery of support disk 14, except at the attachment points of the stirring blades 16. The teeth 26 lie, preferably, in the surface of conic wall 34 (or form a part thereof), but they can also be bent up or down relative to the conic wall 34.

These teeth 26, which form a toothed ring, make gas emergence more uniform and improve dispersion of the gas introduced via feed pipe 28 into cavity 36. In other words, they support the breakup of the gas bubbles.

FIG. 3 shows an overhead view of the section, i.e., the given sheet metal blank, of stirring blade 16, before it is bent into a working shape. Blank 42 is made roughly trapezoidal and on its outside (relative to the later working position), it has a width B1 of 40 mm, for example, and on its inside, a width B2 of 50 mm, for example. Radial length 11 of blank 42 is, for example, 37 to 38 mm. (Of course, the invention is not limited to this size which is mentioned only as an example).

Along its middle line 44, the blank 42 is bent in a wedge-shape such that two sides 18 and 20 of the wedge enclose a wedge angle α, as is indicated in FIG. 4. Wedge angle α is preferably in the range of from about 45° to 75° and it is preferably about 60°. Inner end sections 22 and 24 of the two sides 18 and 20, i.e., inner when viewed in radial direction A (FIGS. 1 and 3), are bent up by an angle of β (FIG. 4) along bending lines 46 and 48 relative to the location of blank 42 shown in FIG. 3. The angle β between the respective end section 22, 24 and the associated sides 18, 20 is, preferably, in the range from about 120° to 160° and it is preferably about 140°.

The end sections 22, 24 of the stirring element 10 are angled outward relative to the sides 18, 20 in the direction of rotary motion P of stirring element 10, as FIGS. 1 & 4 show. End sections 22, 24 are made essentially triangular, and their width increases in the radial direction from the outside to the inside of the stirring blade. On the inner end 50 of the stirring blade, in this example, the width B3 of end sections 22, 24 is about 12.5 mm, this measurement being only an example, and the invention being not limited to it. Length L2 of end sections 22, 24, measured from inner end 50 of the stirring blade 16, can be roughly two thirds to three fourths of the radial length L1 of the stirring blade 16, while the width B3 of the end sections 22, 24 on the inner end 50 of the stirring blade can be about 20% to 30%, preferably about 25%, of the total width of stirring blade blank 42.

With the stirring element according to the invention, a low output power coefficient is achieved. Gas feed is simplified and clogs are prevented. Furthermore, the conical construction of the support disk and its toothed ring on its outside edge enable a uniform distribution and good dispersion of the gas bubbles.

While a single embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. A stirring element for stirring of liquids to which a gas is supplied, comprising a hub for attachment to a stirring shaft, and a support disk joined to the hub, and a plurality of stirring blades attached to a peripheral edge of the support disk; wherein each stirring blade has a wedge shape in a direction of rotational motion about an axis concentric with said hub; and wherein radial inner end sections of two sides of the stirring blade are angled outwardly relative to the direction of rotational motion of the stirring element and said sides.

2. A stirring element as claimed in claim 1, wherein said wedge shape of each of the stirring blades is formed by a pair of side walls that are disposed at a wedge angle with respect to each other of about 45° to 75°.

3. A stirring element as claimed in claim 2, wherein the wedge angle of the stirring blades is 60°.

4. A stirring element as claimed in claim 1, wherein an angle between each side and its angled end section is 120° to 160°.

5. A stirring element as claimed in claim 4, wherein the angle between each side and its angled end section is about 140°.

6. A stirring element as claimed in claim 1, wherein the end sections are triangular and their width increases in a radially inward direction.

7. A stirring element as claimed in claim 1, wherein a radial length of the end sections is about two thirds to three fourths of a radial length of the stirring blades; and wherein a width of each end section is about 20% to 30% of the width of the stirring blades.

8. A stirring element as claimed in claim 7, wherein the width of each end section is about 25% of the width of the stirring blades.

9. A stirring element as claimed in claim 1, wherein the support disk has a wall that is angled away from a bottom end of the hub in a manner forming a cavity under the hub.

10. A stirring element as claimed in claim 9, wherein said wall of the support disk has one of arched, tapering and conical shapes.

11. A stirring element as claimed in claim 10, wherein the wall of the support disk has a conical shape forming an opening angle of about 140° to 150°.

12. A stirring element as claimed in claim 11, wherein the opening angle is about 146°.

13. A stirring element as claimed in claim 9, wherein an outer edge of the support disk is provided with triangular teeth.

14. A stirring element as claimed in claim 13, wherein said teeth are parallel to said wall of the support disk.

15. A stirring element as claimed in claim 13, wherein said teeth are angled relative to said wall of the support disk.

16. A stirring element as claimed in claim 9, wherein a feed pipe is provided for introducing gas into said cavity.

* * * * *